US010350457B2

(12) United States Patent
Ducharme

(10) Patent No.: US 10,350,457 B2
(45) Date of Patent: Jul. 16, 2019

(54) FLOWING FIN SYSTEM AND TAIL ASSEMBLY

(71) Applicant: Eric Jonathon Ducharme, Homosassa, FL (US)

(72) Inventor: Eric Jonathon Ducharme, Homosassa, FL (US)

( * ) Notice: Subject to any disclaimer, the term of this patent is extended or adjusted under 35 U.S.C. 154(b) by 0 days.

(21) Appl. No.: 15/973,587

(22) Filed: May 8, 2018

(65) Prior Publication Data

US 2018/0326261 A1 Nov. 15, 2018

Related U.S. Application Data

(60) Provisional application No. 62/602,915, filed on May 11, 2017.

(51) Int. Cl.
*A63B 31/11* (2006.01)

(52) U.S. Cl.
CPC ..... *A63B 31/11* (2013.01)

(58) Field of Classification Search
CPC ... A63B 31/11; A63B 31/10; A63B 2031/112; A63B 2031/115; A63B 31/12; A63B 31/08
See application file for complete search history.

(56) References Cited

U.S. PATENT DOCUMENTS

| | | | | |
|---|---|---|---|---|
| 3,810,269 | A * | 5/1974 | Tabata | A63B 31/11 441/64 |
| 3,908,213 | A * | 9/1975 | Hill | A63B 31/11 441/64 |
| 5,290,194 | A * | 3/1994 | Sneddon | A63B 31/11 441/64 |
| 5,595,518 | A * | 1/1997 | Ours | A63B 31/11 264/244 |
| 6,095,879 | A * | 8/2000 | McCarthy | A63B 31/11 441/64 |
| 6,224,443 | B1 * | 5/2001 | Mehrmann | A63B 31/11 441/64 |
| 9,162,110 | B1 | 10/2015 | Browning et al. | |

OTHER PUBLICATIONS

Mahina-mermaid. (n.d.). Mahina Mermaid. Retrieved May 7, 2018, from https://www.mahinamermaid.com/.
Mar, M., & N. (Sep. 7, 2017). Luna Fin. Retrieved May 7, 2018, from https://www.finisswim.com/Luna-Monolin.
Mermaid Tails. (n.d.). Retrieved May 7, 2018, from https://www.themertailor.com/.

* cited by examiner

*Primary Examiner* — Andrew Polay
(74) *Attorney, Agent, or Firm* — Dunlap Bennett & Ludwig PLLC

(57) ABSTRACT

A flowing fin assembly for swimmers is provided. The flow assembly is adapted to provide excellent comfort, good propulsion properties and also has a gentle flowing appearance that is similar to the flow properties of a Betta fish as swimmer traverses through the water.

8 Claims, 4 Drawing Sheets

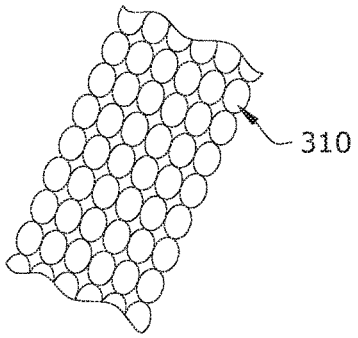
FIG.6A
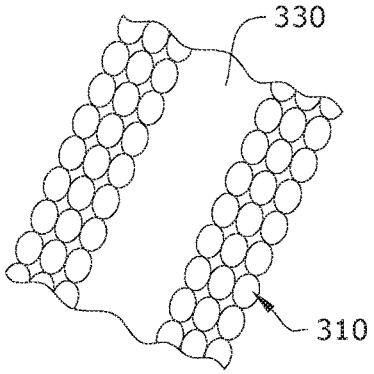
FIG.6B
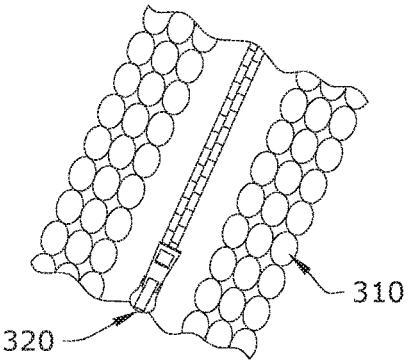
FIG.6C
FIG.6D
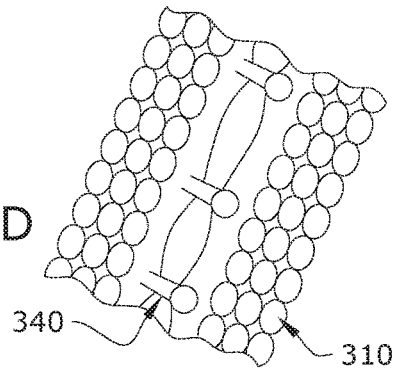

FLOWING FIN SYSTEM AND TAIL ASSEMBLY

CROSS-REFERENCE TO RELATED APPLICATION

This application claims the benefit of priority of U.S. provisional application No. 62/602,915, filed 11 May 2017, the contents of which are herein incorporated by reference.

BACKGROUND OF THE INVENTION

The present invention relates to swimming accessories and, more particularly, to a flowing fin and tail assembly adapted to provide excellent comfort, good propulsion properties and also has a gentle flowing appearance that is similar to the flow properties of a Betta fish or the graceful flow of a hypothetical mermaid as they traverse through the water. The flowing fin assembly may provide a monofin having a unique balance of properties that replicates the graceful flow of the hypothetical mermaid as it moves in the water. Especially when adding an adjoining soft, mermaid tail portion afforded by the present invention.

Many people have the fantasy of becoming a mermaid or a merman. There are many commercially available costumes that try to simulate the experience of being a fictional creature but most of these systems fall woefully short of creating a true experience that replicates the fantasy.

The first system is described in U.S. Pat. No. 9,162,110 by Browning et al. A monofin, mermaid tail, and method of applying the tail and monofin. The fin utilizes a core made of flexible, yet resilient material such as plastic and a cover that is elastic, such as neoprene. The user's feet are connected to the fin by releasable connections. The mermaid tail and monofin connects both of a user's feet and legs in order to facilitate swimming in a mermaid-like motion while giving the user the appearance of a mermaid. A mermaid tail of printed elastic fabric is worn over the top of the fin and encasing the legs of the user. The problem with this system is that the fin system as described is good for propulsion through water but the rigidity of the fin structure does not replicate the fluidity of flow of a mermaid's tail.

The second system is Mahina Merfin's from Byron Bay New South Wales Australia. This is a relatively large fin made of rubber or recycled rubber products. The rigid nature of the foot holders makes the system extremely uncomfortable. The rubber almost cuts into the skin after prolonged use.

The third system is a monofin system called the Luna monofin from Finis Inc. with offices in Livermore Calif., USA. This system is comprised of silicone rubber. The rigidity of the fin is still excessive and the system does not demonstrate the graceful flow properties needed to simulate the mermaid experience. The food holders are adjustable but do not remain intact when the fin is being used. The foot holders can easily unintentionally pop off your feet in use.

A fourth system is a silicone tail that is manufactured by the Mertailer Corporation of Crystal River Fla., USA. The full-size silicone tails are actually a composite of a flexible yet resilient plastic center layer that provides rigidity to the structure. The plastic resilient layer also incorporates rubber foot holders. The plastic resilient layer with foot holders is inserted in a molding operation where the majority of the fin element are covered on the top and bottom surface with a silicone rubber leaving the foot holders uncovered by the silicone. The silicone rubber extends up to 18 inches in excess of the dimensions defined by the plastic resilient layer. The center of the construction is a relatively rigid resilient monofin with foot holders. To complete the costume, the tail construction can be glued with a silicone adhesive to silicone tail that was formed on an elastic fabric. This construction is cumbersome to manufacture requiring molding and curing of multiple layers. The foot holders are not the most comfortable. There is a potential for the silicone rubber to delaminate from the resilient plastic layer. There is also the potential for the resilient monofin layer to cut through the silicone that extends past the end of the resilient plastic monofin.

As can be seen, there is a need for a monofin system that not only provides foot holders that are durable, snug and comfortable, but that provides adequate propulsion, while providing the delicate flow properties similar to the tail of a Koi fish or Betta fish. It is desirable for a monofin and a tail assembly that can be decorated to have the desired appearance. It is also desirable for a fin system that can be manufactured in a more efficient manner. The present invention provides the unique combination of comfort, propulsion properties and the flow properties in water needed for an individual to replicate the fantasy of becoming a mermaid or a merman. This invention can be easily manufactured and decorated to efficiently provide a unique fin and tail assembly to enhance the customer's experience.

SUMMARY OF THE INVENTION

In one aspect of the present invention, a swimming apparatus includes a fin portion defining a radial shape extending from a proximal end to a distal end; one or more foot holders connected to the proximal end, each foot holder adapted to receive and retain a foot of a user; a plurality of spaced-apart ribs radially extending from the proximal end; and a plurality of thin portions, each thin portion extending between each two adjacent spaced-apart ribs of the plurality of ribs, each thin portion having a durometer less than a durometer of each rib.

In another aspect of the present invention, the swimming apparatus includes a fin portion defining a radial shape extending from a proximal end to a distal end; one or more foot holders connected to the proximal end, each foot holder adapted to receive and retain a foot of a user, wherein each foot holder further includes a reinforced layer encased in an elastic material; a plurality of spaced-apart ribs radially extending from the proximal end; and a plurality of thin portions, each thin portion extending between each two adjacent spaced-apart ribs of the plurality of ribs, wherein each rib has a first durometer, wherein each thin portion has a second durometer, wherein the first durometer is greater than the second durometer, wherein the first durometer has a shore A scale range between 45 and 25, wherein each rib and each thin portion are made of the same material, wherein each rib has a taper cross section thickness that only equals cross sectional thickness of the plurality of think portions at the distal end.

These and other features, aspects and advantages of the present invention will become better understood with reference to the following drawings, description and claims.

BRIEF DESCRIPTION OF THE DRAWINGS

FIG. 6A is an enlarged detail view of an exemplary embodiment of a tail portion of the present invention with no seam;

FIG. 6B is an enlarged detail view of an exemplary embodiment of a tail portion of the present invention with an elastic region;

FIG. 6C is an enlarged detail view of an exemplary embodiment of a tail portion of the present invention with a detachable fastener;

FIG. 6D is an enlarged detail view of an exemplary embodiment of a tail portion of the present invention with a removably fastener;

DETAILED DESCRIPTION OF THE INVENTION

Figure 1:
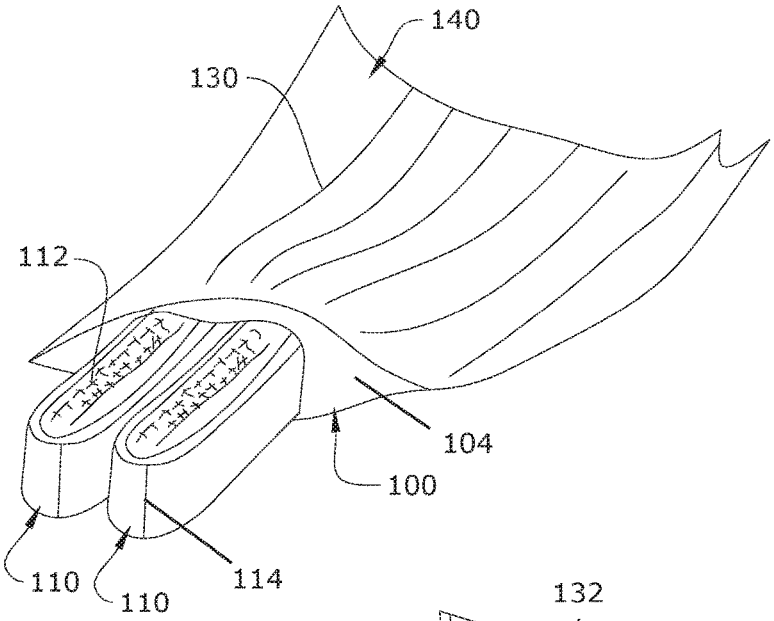
FIG. 1 is a perspective view of an exemplary embodiment of the present invention.
Figure 2:
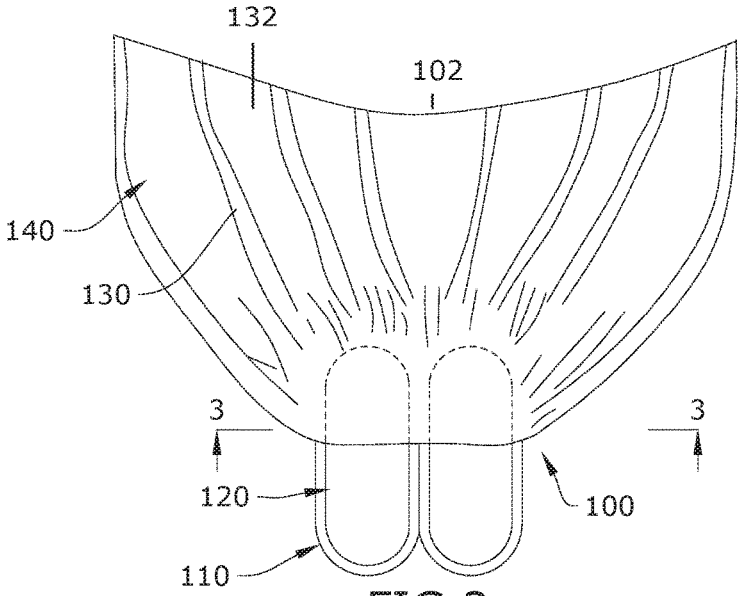
FIG. 2 is a top plan view of an exemplary embodiment of the present invention.
Figure 3:
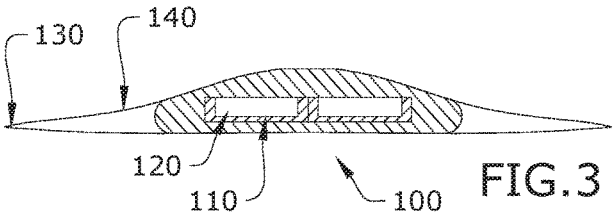
FIG. 3 is a side elevational view of an exemplary embodiment of the present invention.
Figure 4:
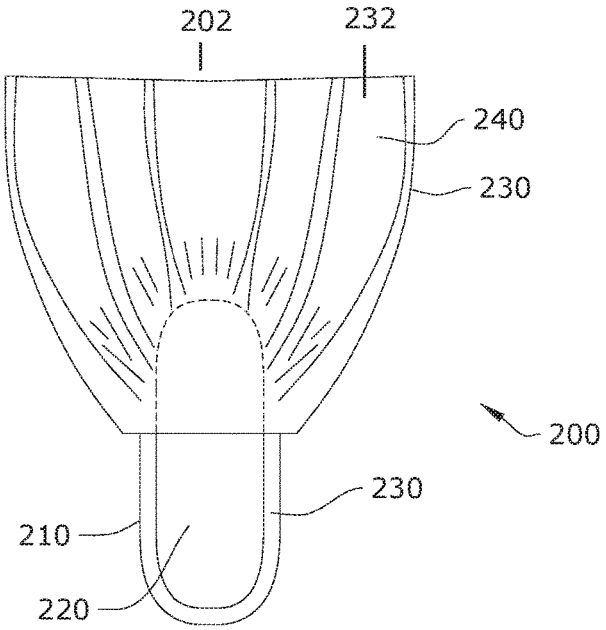
FIG. 4 is a top plan view of an exemplary embodiment of a single-foot flipper of the present invention.
Figure 5:
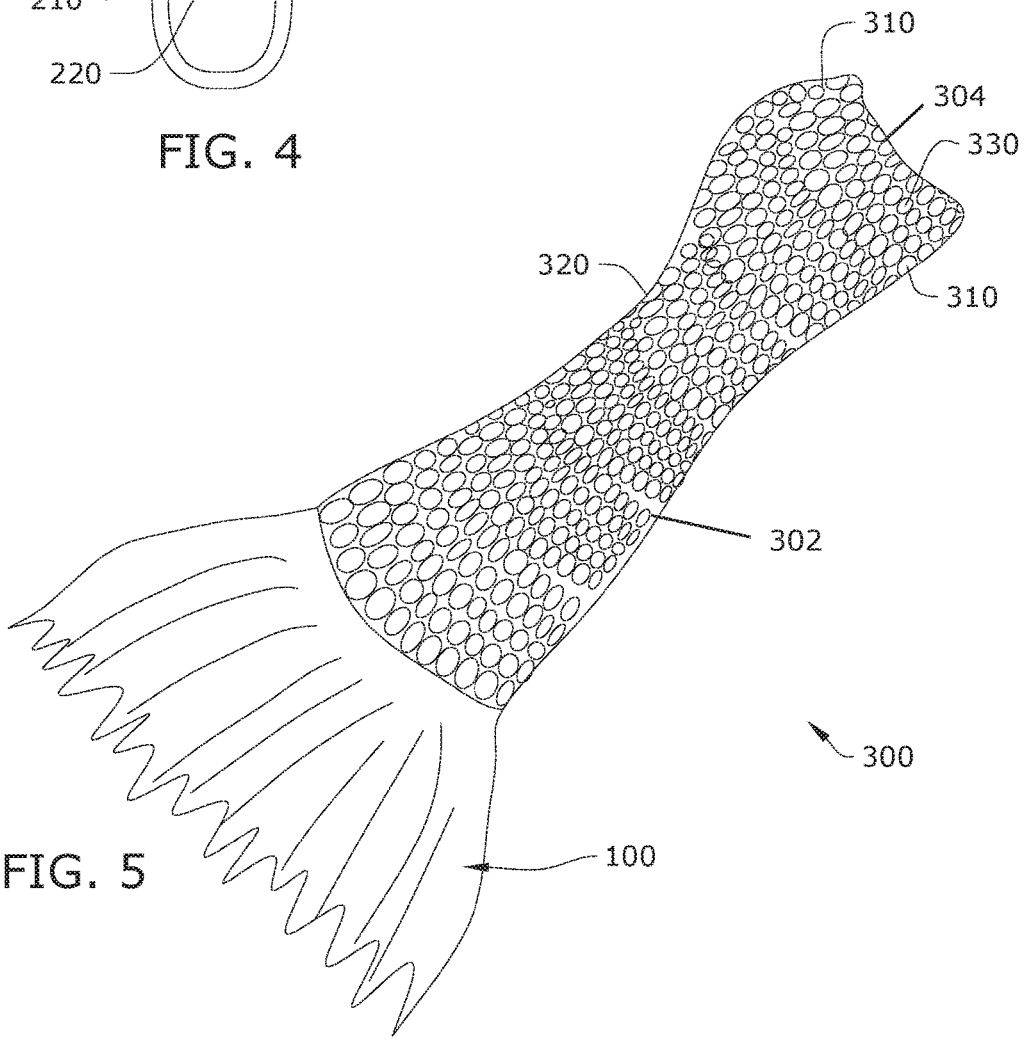
FIG. 5 is a perspective view of an exemplary embodiment of a monofin integrated with a tail portion of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a flowing fin assembly adapted to provide excellent comfort, good propulsion properties and also has a gentle flowing appearance that is similar to the flow properties of a Betta fish as swimmer traverses through the water.

Referring to FIGS. 1 through 7, the present invention may include a monofin system 100 and a swim fin system 200. In certain embodiments, the monofin system 100 incorporates an integrated tail portion 300 or an overlapping tail portion 400.

The monofin system 100 may include a fin portion 140 and two foot holders 110 extending from a proximal end 104 of the fin portion 140. Each foot holder 110 may be a separate cavity 120 for receiving and for attaching to the feet of a user. Each cavity 120/220 passes into the proximal end 104 in order to secure both user's feet therein. Foot holder 110 may be made soft durometer plastic coupled with a reinforcement layer 112. In one embodiment, the reinforcement layer 112 may be molded or glued in regions of the foot holder 110 to prevent removable of the user's foot prematurely during aggressive propulsion. The reinforcement can be a reinforcement strap 114, as illustrated in FIG. 1, around the rear of the foot holder 110. The reinforcement layer 112 can be on the base of the foot holder. The reinforcement layer 112 can be in both the base and as well as the rear of the foot holder. Preferably, the reinforcement layer 112 can be molded into the foot holder 110 in such a manner that reinforcement layer 112 is totally encased in a soft rubber. The advantage of encasing the reinforcement layer 112 in the soft rubber is that it provides the user with tremendous comfort while providing a stable foot holder 110. The reinforcement layer 112 can be a woven fabric, a non-woven fabric, a polymeric film or a polymeric mesh, a glass fiber system or a glass fiber matt, a ceramic fiber system or matt. The reinforcement layer can have a range of flexibility or elastic. Another approach for creating a uniform reinforcement layer is where a sock (not shown) is molded into the entire foot holder 110.

Yet another option is where the reinforced region is created with a soft polymer that is blended with fibrous or other reinforcing fillers, wherein fibers are blended into the plastic used to form the foot holders. The fibers or fillers could be glass fibers or rigid polymeric fibers that are blended with the polymers used to create the foot holder region of the fin system. Instead of a reinforced layer as described immediately above, such a region of the foot holder 110 could instead or in addition include fiber filled plastic region as reinforcement, providing both the softness needed for user comfort and filler needed for enhanced reinforcement. The foot holders 110 can be molded in a variety of sizes to accommodate the different foot sizes of users. Ideally the foot holders 110 and the fin portions 140 are molded together in one process. For process efficiency, one can envision where the fin portion 140 has been molded and the foot holders 110 are incorporated into the fin in a secondary operation.

The fin portions 140 (for the monofin system 100) and 240 (for the swim fin system 200) extend from the proximal end 104 to a distal end 102. Each fin portion 140/240 has alternating, spaced apart thicker portions 130 and 230 and thinner portions 132 and 232. The thicker portions 130/230 could be in the shape of ribs and the thinner portions 132/232 could be non-ribbed areas having a radial shape to them as the thicker portions 130/230 tend to extend "radially" from the proximal end 104. By 'radial shape' the inventor means a shape reminiscent to an unfolded folding hand fan.

These unique fin portions 140/240 enable the appearance of a Betta fish or Koi fish as it traverses through the water, as the fin portions 140/240 demonstrate sinusoidal wave properties as it flows through the water under propulsion of the user. This sinusoidal wave property of the fin movement in water is unique and creates a unique realistic user experience. To achieve this elegant flow property while maintaining good propulsion through the water, a balance of properties in the fin are required. As mentioned above, each fin portion 140/240 contains spaced apart, alternating thinner portions 132/232 and thicker portions 130/230. The thicker portions 130/230 could be ribbed regions and the thinner portions 132/232 could be non-ribbed regions. The fin portion 140/240 may have a certain length and width. The length of the fin system can range from 15 cm past the end of the foot holders 110 to 130 cm past the end of the foot holders 110. To be more specific, such measurements are from the distal end 102 to the foot holder 110-proximal end 104 interface. The width of the fin portion 140/240 can extend 2.5 cm outside of the adjacent foot holder 110 to 60 cm on either side of the adjacent foot holder 110. Thus, in certain embodiments, the distance from proximal end 104 to the distal end 102 ranges from 15 cm to 130 cm in length, while the fin portion 140/240 tapers outward as it extends from the proximal end 104 to the distal end 102 (having a width of 60 cm). In alternative embodiments, the fin portion 140/240 may be 4 ft long×4 ft wide.

The thicker portions 130/230 adds a rigidity that helps facilitate the propulsion through the water, while the thinner portions 132/232 provides some degree of propulsion but also provides the gentle aesthetic flow of the fin as it moves through the water. These portions not only impact the propulsion properties of the fin and the flow properties of the fin traversing through the water, but also impact the aesthetic properties of the fins.

The property of the thicker portions 130/230 and thinner portions 132/232 of the fin portions 140/240 is best defined by the by the durometer of the materials used to create these regions. The durometer is the international standard for the hardness measurement of rubber, plastic and other non-metallic materials. Durometers are described in the American Society for Testing and Material specification ASTM D2240, which is the recognized specification for the instrument and test procedures. The durometer is a measure of the force required to create a deformation in the material. There are several scales of durometer, used for materials with different properties. The two most common scales, using slightly different measurement systems, are the ASTM D2240 type A and type D scales. The A scale is for softer plastics, while the D scale is for harder ones. However, the ASTM D2240-00 testing standard calls for a total of 12 scales, depending on the intended use; types A, B, C, D, DO, E, M, O, OO, OOO, OOO—S, and R. Each scale results in a value between 0 and 100, with higher values indicating a harder material Test setup for type A & D

| Durometer | Indenting foot | Applied mass (kg) | Resulting force (N) |
|---|---|---|---|
| Type A | Hardened steel rod 1.1 mm-1.4 mm diameter, with a truncated 35° cone, 0.79 mm diameter | 0.822 | 8.064 |
| Type D | Hardened steel rod 1.1 mm-1.4 mm diameter, with a 30° conical point; 0.1 mm radius tip | 4.550 | 44.64 |

The ASTM D2240 standard recognizes twelve different durometer scales using combinations of specific spring forces and indenter configurations. These scales are properly referred to as durometer types; i.e., a durometer type is specifically designed to determine a specific scale, and the scale does not exist separately from the durometer.

scale. It is for this reason that multiple scales exist. Durometer is a dimensionless quantity, and there is no simple relationship between a material's durometer in one scale, and its durometer in any other scale, or by any other hardness test. There have been attempts to correlate durometer and elastic modulus that have proven successful for small elastic deformations in the plastic. For the purpose of this invention, durometer was chosen to measure the relative hardness or stiffness of the material.

To create the balance of properties, this invention preferably uses a rubberized material in the thicker or ribbed portions 130/230 that has a shore A hardness of less than 45 on the Shore A Scale, more preferably less than 40 on a shore A Scale and more preferably less than 35 on a shore A scale and more preferably 25 on a Shore A scale. The foot holders 110 can utilize a rubber with a Shore hardness less than the ribbed region. The non-ribbed or thinner portions 132/232 can utilize a rubber or plastic with a Shore A less than the thicker or ribbed portions 130/230. It is possible to have the thicker or ribbed portions 130/230 and the non-ribbed or thinner portions 132/232 with different durometers.

Another property important for the invention is the tear strength of the material measured by ASTM D624 using Die B or Die T. For Die B the tear strength it is preferable for the tear strength be greater than 3 kN/m. For Die T it is preferable to have the tear strength to be greater than 0.4 kN/m.

Materials can be chosen from a variety of rubberized and or plasticized materials. The materials can be silicone rubbers, urethane rubbers, or olefin based elastomers. The material can be neat or filled. The fillers can include organic and inorganic pigments, metallic flakes, polymeric flakes, metalized polymeric flakes, pearlescent pigments, glass fibers, glass bubbles, polymeric bubbles, polymeric beads, glass beads, reflective elements, amorphous silica, phosphorescent materials, and color changing pigments that are temperature dependent.

| Durometer type | Configuration | Diameter | Extension | Spring force |
|---|---|---|---|---|
| A | 35° truncated cone (frustum) | 1.40 mm (0.055 in) | 2.54 mm (0.100 in) | 822 gf (8.06 N) |
| C | 35° truncated cone (frustum) | 1.40 mm (0.055 in) | 2.54 mm (0.100 in) | 4,536 gf (44.48 N) |
| D | 30° cone | 1.40 mm (0.055 in) | 2.54 mm (0.100 in) | 4,536 gf (44.48 N) |
| B | 30° cone | 1.40 mm (0.055 in) | 2.54 mm (0.100 in) | 822 gf (8.06 N) |
| M | 30° cone | 0.79 mm (0.031 in) | 1.25 mm (0.049 in) | 78 gf (0.76 N) |
| E | 2.5 mm (0.098 in) spherical radius | 4.50 mm (0.177 in) | 2.54 mm (0.100 in) | 822 gf (8.06 N) |
| O | 1.20 mm (0.047 in) spherical radius | 2.40 mm (0.094 in) | 2.54 mm (0.100 in) | 822 gf (8.06 N) |
| OO | 1.20 mm (0.047 in) spherical radius | 2.40 mm (0.094 in) | 2.54 mm (0.100 in) | 113 gf (1.11 N) |
| DO | 1.20 mm (0.047 in) spherical radius | 2.40 mm (0.094 in) | 2.54 mm (0.100 in) | 4,536 gf (44.48 N) |
| OOO | 6.35 mm (0.250 in) spherical radius | 10.7-11.6 mm (0.42-0.46 in) | 2.54 mm (0.100 in) | 113 gf (1.11 N) |
| OOO-S | 10.7 mm (0.42 in) radius disk | 11.9 mm (0.47 in) | 5.0 mm (0.20 in) | 197 gf (1.93 N) |

The final value of the hardness depends on the depth of the indenter after it has been applied for 15 seconds on the material. If the indenter penetrates 2.54 mm (0.100 inch) or more into the material, the durometer is 0 for that scale. If it does not penetrate at all, then the durometer is 100 for that There also is an option where the ribbed or thicker portions 130/230 could be made with rigid tube that is placed in the mold. The tubes or cylinders can be made of polyolefin materials like polyethylene or polypropylene, polyurethanes, or rubbers like EPDM, poly isoprene or natural rubbers. Use of these rigid elements allows the fin system to flex yet the non-ribbed areas can flow. Not all of the ribbed areas need to contain this tube or cylinder. It could be in select regions of the fin to provide unique flow properties desired by the end user. Common rubbers are available through the Polytek Development Corporation, 55 Hilton Street, Easton, Pa., USA.

A method of using the present invention may include the following. The monofin system 100 and/or the swim fin system 200 disclosed above may be provided. A user may don the monofin system 100 or the swim fin system 200 by sliding their foot into the sock (not shown) and the foot holder 110, wherein the monofin system 100 both feet are incorporated into a single fin portion 140, and in the swim fin system 200 only a single foot holder 210 is incorporated in the fin portion 240. In certain embodiments, the user primarily feels the sock fabric (not shown) against their skin.

The monofin system 100, where both feet are incorporated in the fin portion 140, results in a dolphin style motion by the user with the feet moving together in an up and down motion. The movement can also include a rotation by the user involving a spinning motion. The swim fin system 200 has one foot holder 210 per fin portion 240, and thus the user's feet can move in tandem or they can move independently. The user can also incorporate a scissors kick or the user can incorporate a frog style kick. With the scissors kick, the frog style kick, the dolphin style kick and the spinning or rotational motion, the user would like the fin portions 140 or 240 to have a sinusoidal flow as it traverses through the water.

An embodiment of the present invention may incorporate the monofin portion 140 with a tail portion 300 that is part of the costume and enhances the end user's experience. In this case, the tail portion 30 may provide a tubular section 302 made of a nylon and Spandex blend dimensioned and adapted to surround a user's legs. The tail portion 30 has a waist section 304 that holds the tail portion 304 around a user's waist. The tubular section 302 may include alternating three-dimensional soft portions 310 and elastic fabric portions 330.

The fabric tube of the tubular section 302 can be supported by a flat table or a three-dimensional backer. The tail portion 300 can be molded by spreading the rubber into the mold and then laminating a fabric or a mesh to the uncured silicone. The mold could be inserted with a fabric on a three-dimensional backer is such a way that the fabric coated backer is inserted into the mold that has been coated with the rubber. The silicone is allowed to cure against the fabric. When the mold is opened. The rubberized material is cured to the fabric and the image in the mold is uniformly applied to the fabric portions 330. Three dimensional soft portions 310 can also be fastened to the supported fabric portions 330. For example, a silicone rubber can be adhered to the fabric using a silicone adhesive. The silicone rubber can be coated onto the fabric and then the three-dimensional structure of the silicone can be created with a screen or a mesh. The screen or mesh can be removed after the silicone is cured enough to take its shape. Other three-dimensional elements can be attached such as metal articles, plastic strings, additional mono fins, strings or other decorative elements.

The tail portion 300 can be seamless or can have seams 320. The seam 320 could have elements like a detachable fastener zipper, hook and loop fasteners 340, buttons or snaps to facilitate rapid egress in case of an emergency.

Figure 7:
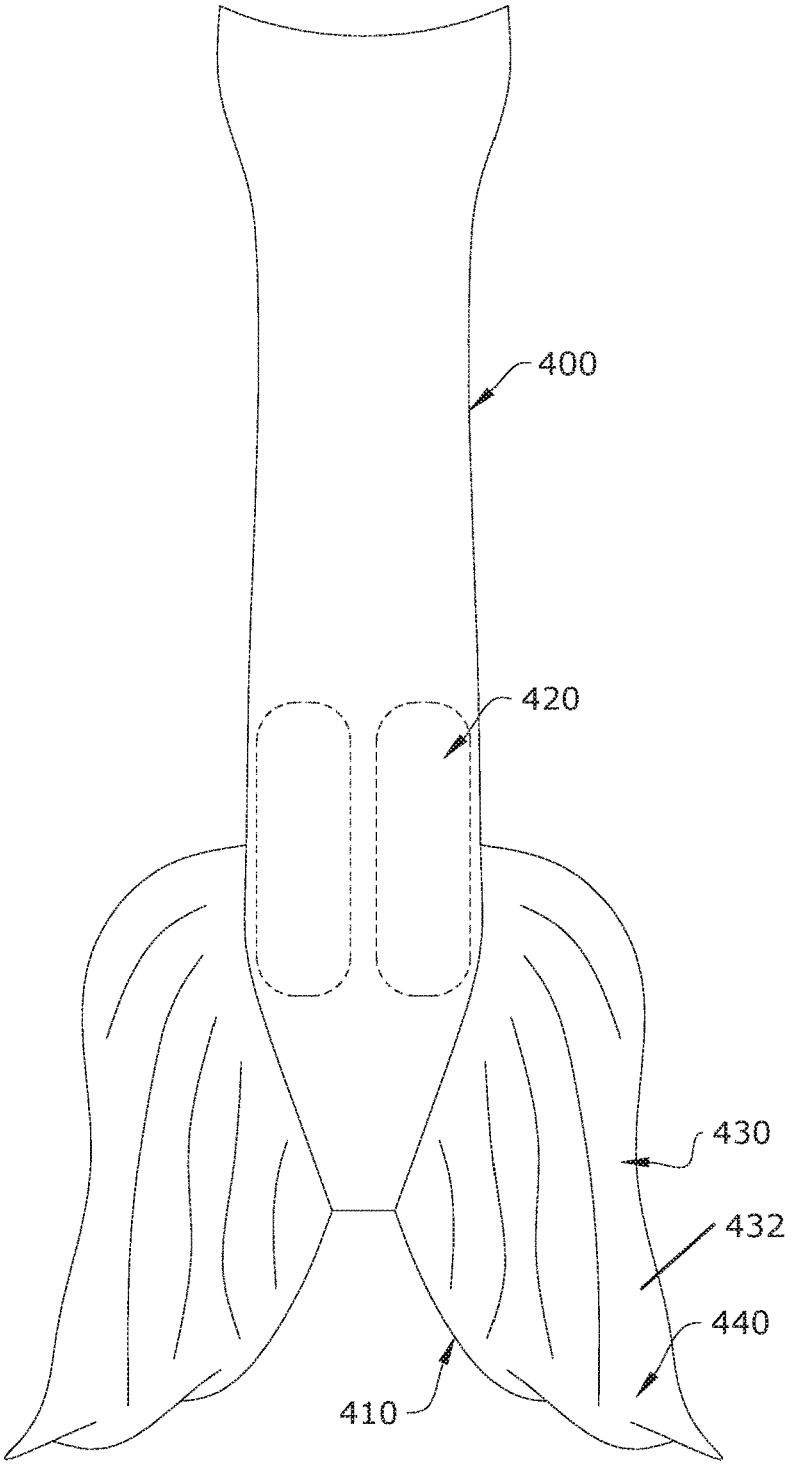
FIG. 7 is a view of a monofin integrated with an overlapping tail portion.

The tail portion 300 can be permanently attached to the monofin system 100 using an adhesive system. The fabric of the tail portion 300 can be draped over the fin portion 440 essentially integrating the tail portion 300 thereto, but in a way that it is removable and not permanent. This offers the user to offer design flexibility and provide customers with enhanced customization. FIG. 7 represents an integrated tail and fin system with an overlapping fabric portion [???] of the tail 400. The fin system has a notch 410 [???] designed for a fabric overlap. The fin system incorporates a reinforced foot holder 420. The fin system includes ribbed/thicker portions 430 and non-ribbed thinner portions 432 of the fin portion 440.

The tail portion 300 can be painted or decorated to customize the product for the end user. The fin systems 100 and 200 can also be painted or decorated to customize the product for the end user. Elastic fabrics or rubberize tails can be decorated by direct printing or with sublimation transfer printing techniques.

It should be understood, of course, that the foregoing relates to exemplary embodiments of the invention and that modifications may be made without departing from the spirit and scope of the invention as set forth in the following claims.

What is claimed is:

1. A swimming apparatus comprising:

a fin portion defining a radial shape extending from a proximal end to a distal end;

one or more foot holders connected to the proximal end, each foot holder adapted to receive and retain a foot of a user, wherein each foot holder further includes a reinforced layer encased in an elastic material, wherein the reinforced layer is stiffer than the elastic material;

a plurality of spaced-apart ribs radially extending from the proximal end; and a plurality of thin portions, each thin portion extending between each two adjacent spaced-apart ribs of the plurality of ribs.

2. The swimming apparatus of claim 1, wherein each thin portion is comprised of a material having a durometer different than that of each spaced-apart rib.

3. The swimming apparatus of claim 1, wherein each thin portion has a durometer less than a durometer of each rib.

4. The swimming apparatus of claim 2, wherein each rib has a first durometer, wherein each thin portion has a second durometer, and wherein the first durometer is greater than the second durometer.

5. The swimming apparatus of claim 4, wherein the first durometer has a shore A scale range between 45 and 25.

6. The swimming apparatus of claim 1, wherein each rib and each thin portion are made of the same material.

7. The swimming apparatus of claim 1, wherein each rib has a taper cross section thickness that only equals cross sectional thickness of the plurality of think portions at the distal end.

8. A swimming apparatus comprising:

a fin portion defining a radial shape extending from a proximal end to a distal end;

one or more foot holders connected to the proximal end, each foot holder adapted to receive and retain a foot of a user, wherein each foot holder further includes a reinforced layer encased in an elastic material, wherein the reinforced layer is stiffer than the elastic material;

a plurality of spaced-apart ribs radially extending from the proximal end; and a plurality of thin portions, each thin portion extending between each two adjacent spaced-apart ribs of the plurality of ribs, wherein each rib has a first durometer, wherein each thin portion has a second durometer, wherein the first durometer is greater than the second durometer, wherein the first durometer has a shore A scale range between 45 and 25,wherein each rib has a taper cross section thickness that only equals cross sectional thickness of the plurality of think portions at the distal end.

* * * * *